US010559416B2

(12) United States Patent
Luk et al.

(10) Patent No.: US 10,559,416 B2
(45) Date of Patent: Feb. 11, 2020

(54) ELECTRICAL DEVICE WITH REINFORCED MOLDED PINS

(71) Applicants: XFMRS, Inc., Camby, IN (US); Tung Kong Luk, Tsuen Wan (HK); Yu Kun Liao, GuangDong (CN)

(72) Inventors: Tung Kong Luk, Tsuen Wan (HK); Yu Kun Liao, GuangDong (CN)

(73) Assignee: XFMRS, Inc., Camby, IN (US)

( * ) Notice: Subject to any disclaimer, the term of this patent is extended or adjusted under 35 U.S.C. 154(b) by 135 days.

(21) Appl. No.: 15/815,204

(22) Filed: Nov. 16, 2017

(65) Prior Publication Data

US 2018/0137968 A1 May 17, 2018

Related U.S. Application Data

(60) Provisional application No. 62/423,188, filed on Nov. 16, 2016.

(51) Int. Cl.
*H01F 27/29* (2006.01)
*H01F 27/24* (2006.01)
*H01F 27/32* (2006.01)

(52) U.S. Cl.
CPC ..... *H01F 27/292* (2013.01); *H01F 27/24* (2013.01); *H01F 27/325* (2013.01)

(58) Field of Classification Search
CPC ..... H01F 27/292; H01F 27/29; H01F 27/24; H01F 27/325; H01F 5/02; H01F 2005/043; H01F 2005/046
USPC ..... 336/192, 198, 208, 212
See application file for complete search history.

(56) References Cited

U.S. PATENT DOCUMENTS 4,527,141 A * 7/1985 Post ..... H01F 5/04 336/192
4,544,906 A * 10/1985 Mota ..... H01F 5/06 336/206
4,716,394 A * 12/1987 Gordon ..... H01F 27/306 242/118.41
5,656,985 A 8/1997 Lu et al.
6,133,525 A 10/2000 Yang et al.
6,225,560 B1 5/2001 Machado
7,326,084 B1 2/2008 Chen et al.
7,948,771 B2 5/2011 Zhang et al.
(Continued)

*Primary Examiner* — Mang Tin Bik Lian
(74) *Attorney, Agent, or Firm* — Maginot, Moore & Beck LLP

(57) ABSTRACT

An electronic device includes a molded frame, a core, a coil and a plurality of leads. The molded frame includes central winding bobbin and first and second lateral supports extending laterally outward therefrom. Each of the first and second lateral supports includes a top surface and first and second lower surfaces. The core is disposed about the coil and is supported on the top surfaces of the first and second lateral supports. The leads are formed of conductive material and are molded in the first and second lateral supports. Each of the leads includes a first end portion extending downward from the first lower surface a lateral support, and a second end portion extending along a second lower surface the lateral support. The second lower surface is lower than the first lower surface. The coil is wound about the central winding bobbin. A first end of the coil is affixed to the first end portion of a lead, and a second end of the coil is affixed to the first end portion of another lead.

20 Claims, 2 Drawing Sheets

(56) References Cited

U.S. PATENT DOCUMENTS

| | | | | |
|---|---|---|---|---|
| 8,203,853 | B2 | 6/2012 | Chen | |
| 2007/0046414 | A1* | 3/2007 | Wu | H01F 30/04 336/208 |
| 2008/0211616 | A1* | 9/2008 | Suzuki | H01F 38/08 336/182 |
| 2011/0043315 | A1* | 2/2011 | Kobayashi | H01F 27/2828 336/192 |
| 2012/0001886 | A1* | 1/2012 | Cheon | H01F 27/29 345/211 |

* cited by examiner

ELECTRICAL DEVICE WITH REINFORCED MOLDED PINS

This application claims the benefit of U.S. Provisional Patent Application Ser. No. 62/423,188, filed Nov. 16, 2016, which is incorporated herein by reference.

FIELD OF THE INVENTION

The present invention relates generally to electrical components, and in particular, for electronic devices including a coil in a package for mounting to a circuit board.

BACKGROUND

Surface mount technology is a technology for mounting electrical and electronic components to a printed circuit board. In many cases, the electronic components that are mounted on the printed circuit board are arranged in packages having conductive pins. The package is often in the form of a housing in which digital electronic devices, processors, transistors, and groups of analog devices are contained. In other cases, the package includes a frame that is both a support for, and part of the device itself.

The surface mount process includes placing component packages on predetermined locations on the printed circuit board such that the conductive pins contact predetermined traces on the printed circuit board. The board then undergoes a soldering process, such as an infrared reflow (IR) process, which distributes solder to electrically and physically connect pins of the packages onto conductors on the printed circuit board at the predetermined locations.

A dual in-line surface mount package is a form of surface mount package that includes a case or frame and two rows of surface mount pins or leads. The case of such a device can contain a chip, passive electrical components and/or RF components, among things. For larger analog devices, such as a transformer or choke, the frame can act both as a bobbin around which coils are wrapped, and as a frame or support for the core element and the surface mount pins. One example of such a device is the 53xxx Series SMT current sense transformer available from Murata Power Solutions of Kyoto, Japan. The coil ends are typically electrically connected to respective surface mount pins, to allow circuit connection through the devices. The pins, in turn, are soldered to conductive traces on the printed circuit board as discussed above.

Such devices are known, but can have issues during circuit board assembly that lead to unreliability. Other known devices require manufacturing steps that can lead to damage, or are otherwise complex and costly.

SUMMARY

At least some embodiments of the present invention improve upon the state of the art by providing a case in which the surface mount pins extend along a bottom edge of the frame thereby substantially eliminating the risk of bending. Other embodiments include other or additional features that result in manufacturing and/or use advantages.

A first embodiment is an electronic device includes a molded frame, a core, a coil and a plurality of leads. The molded frame includes central winding bobbin and first and second lateral supports extending laterally outward therefrom. Each of the first and second lateral supports includes a top surface and first and second lower surfaces. The core is disposed about the coil and is supported on the top surfaces of the first and second lateral supports. The leads are formed of conductive material and are molded in the first and second lateral supports. Each of the leads includes a first end portion extending downward from the first lower surface a lateral support, and a second end portion extending along a second lower surface the lateral support. The second lower surface is lower than the first lower surface. The coil is wound about the central winding bobbin. A first end of the coil is affixed to the first end portion of a lead, and a second end of the coil is affixed to the first end portion of another lead.

Another embodiment of the invention is a package for an electronic device that includes a molded frame and a plurality of lead. The molded frame includes a central winding bobbin and first and second lateral supports extending laterally outward therefrom, each of the first and second lateral supports including a top surface and first and second lower surfaces, the central bobbin including a spindle portion configured to receive at least one wound coil. The central winding bobbin further includes at least two flange extensions extending from opposing ends of the spindle portion. Each of the plurality of leads is formed of a conductive material and are molded in the first and second lateral supports. Each of the leads includes a first end portion extending downward from the first lower surface of the corresponding one of the first and second lateral supports, and a second end portion extending along and abutting the second lower surface of the corresponding one of the lateral supports. The second lower surface is lower than the first lower surface.

The integrity of the surface mount portion of the lead (second end) is thus reinforced by the second lower surface of the lateral support. The above-described features and advantages, as well as others, will become more readily apparent to those of ordinary skill in the art by reference to the following detailed description and accompanying drawings.

DETAILED DESCRIPTION

Figure 1:
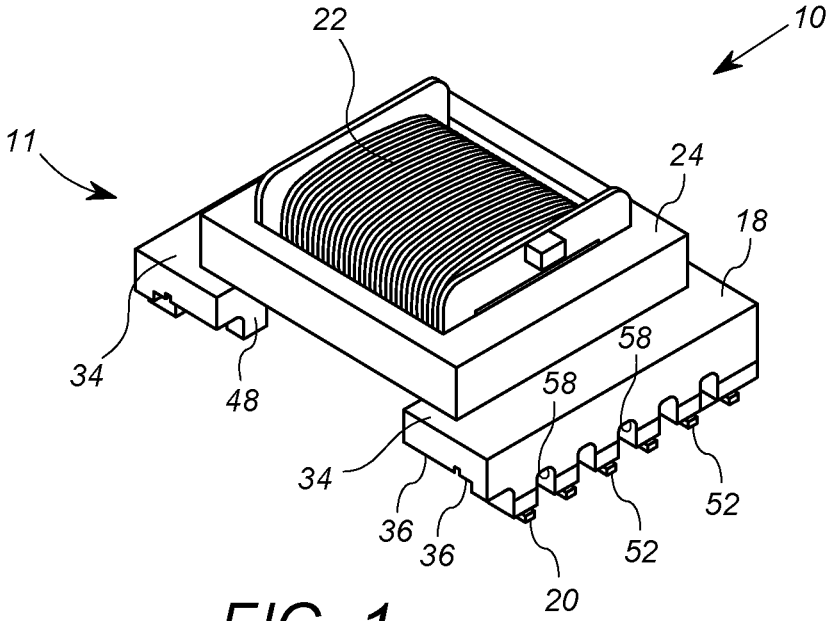
FIG. 1 shows a top perspective view of an electronic device according to a first exemplary embodiment of the invention.
Figure 2:
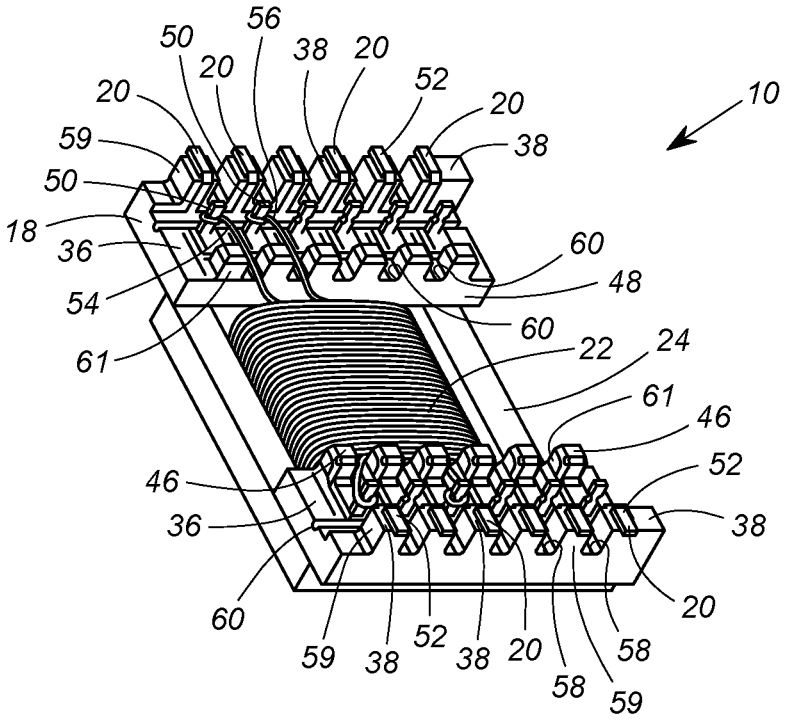
FIG. 2 shows a bottom perspective view of the electronic device of FIG. 1.
Figure 3:
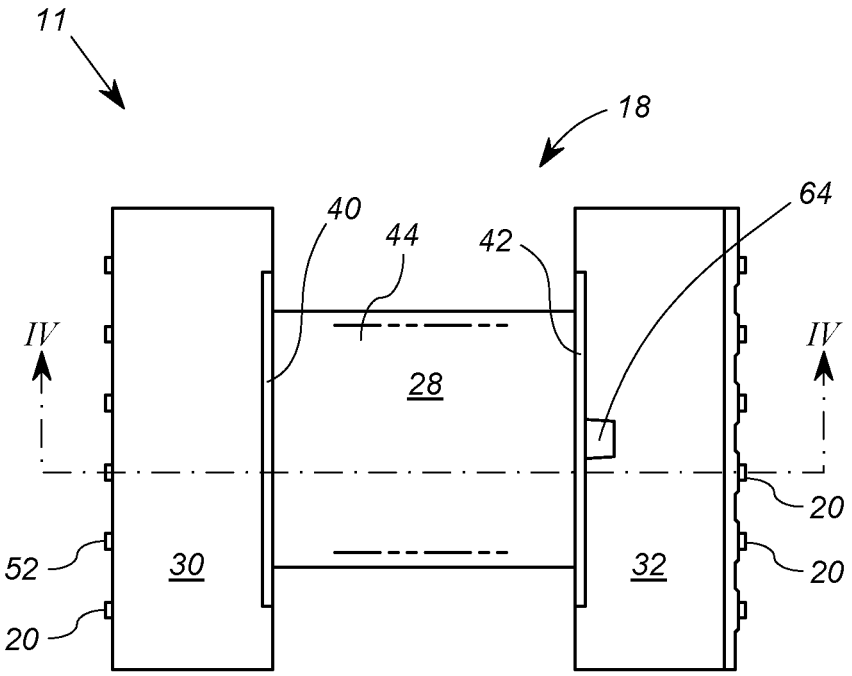
FIG. 3 shows a top plan view of the package of the electronic device of FIG. 1.
Figure 4:
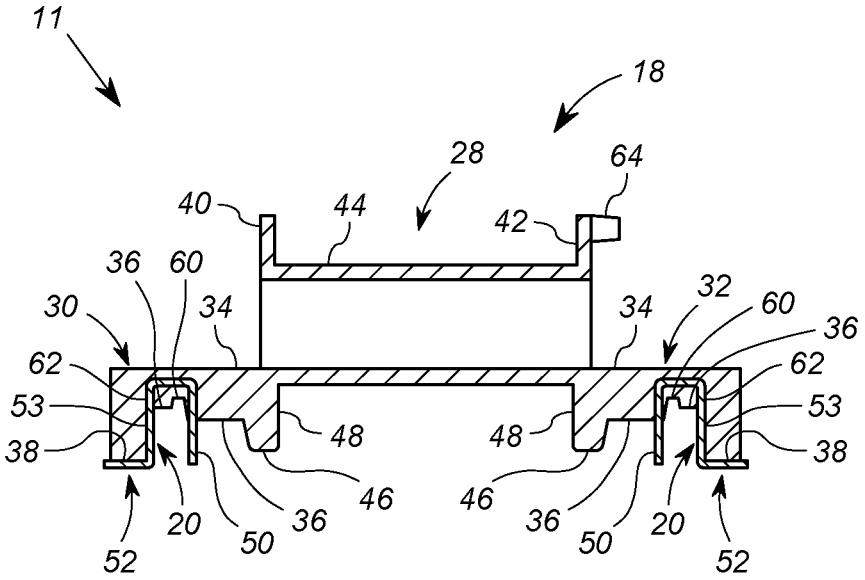
FIG. 4 shows a cutaway view of the package of the electronic device of FIG. 1 taken along line IV-IV of FIG. 3.

FIG. 1 shows a top perspective view of a first embodiment of an electronic device 10 incorporating features of the invention. FIG. 2 shows a bottom perspective view of the device 10. The first embodiment of the device 10 is arranged as a dual in-line package 11 having a molded frame 18 and twelve pins or leads 20, at least one coil 22, and a core 24. FIGS. 3 and 4 show views of the frame 18 and leads 20 apart from the coil(s) 22 and the core 24. Like elements in FIGS. 1 to 4 bear the same reference numbers. It will be appreciated that the package 11 may have other numbers of leads or pins. In this description, vertical orientation is described with respect to the orientation shown in FIGS. 1 and 4, such that FIG. 3 is inverted or upside-down.

With reference specifically to FIGS. 3 and 4, the molded frame 18 includes a central winding bobbin 28 and first and second lateral supports 30, 32 extending laterally outward therefrom. The frame 18 in this embodiment is molded as a unitary, nonconductive structure from any suitable thermoplastic material (or other suitable material) typically used for surface mount housings or transformer bobbins. The central winding bobbin 28 includes a spindle portion 44 configured to receive at least one coil, such as the coil 22, and includes first and second upper flange extensions 40, 42 for axially retaining the coil 22 on the spindle portion 44. Each of the first and second lateral supports 30, 32 includes a top surface 34, a first lower surface 36, a second lower surface 38, and a third lower surface 46. The spindle portion 44 in the present embodiment is in the form of a hollow, substantially rectangular tube.

With reference to FIG. 4, the first lower surface 36, the second lower surface 38 and the third lower surface 46 collectively make up a multi-level lower surface of each of the first and second lateral supports 30, 32. The first lower surface 36 is disposed between the second lower surface 38 and the third lower surface 46. In general, the second lower surface 38 is the laterally outermost lower surface of each lateral support 30, 32, and is the furthest downward from the top surface 34 of the surfaces 36, 38 and 46. The first lower surface 36 is the least furthest downward from the top surface 34 of the surfaces 36, 38 and 46. In this embodiment, the first lower surface 36, has a slightly vertically offset portion. The third lower surface 46 is closest to the spindle portion 44, and is at a vertical level between that of the first lower surface 36 and the second lower surface 38. An inner wall 48 extends from the spindle portion 44 to the third lower surface 46. It will be appreciated that the third lower surface 46 is lower than the first lower surface 36 to allow the inner wall 48 to perform a flange function. In some embodiments, the third lower surface 46 would not be necessary if the first lower portion 36 were sufficiently low enough to allow an inner wall between it and the spindle portion 44 to form a sufficient flange for axially retaining the coil(s) 22

Referring again to FIGS. 1 and 2, the at least one coil 22 is wrapped around the spindle portion 44 of the central winding bobbin 28. The at least one coil 22 is retained axially on the spindle portion 44 by the first and second upper flange extensions 40, 42, as well as by an inner wall surface 48 of each of the lateral supports 30, 32. The core 24 may suitably be at least one magnetic element disposed around the at least one coil 22 and supported on the top surfaces 34 of the first and second lateral supports 30, 32. The core 24 may take other metallic forms having other levels of magnetic permeability as desired.

The plurality of leads 20 are formed of a conductive material, preferably a pliable material, such as copper or phosphor bronze. The leads 20 are molded in the first and second lateral supports 30, 32. Each of the leads 20 includes a first end portion 50 extending downward from the first lower surface 36 of the corresponding one of the first and second lateral supports 30, 32, and a second end portion 52 extending along (and abutting) the second lower surface 38 of the corresponding one of the lateral supports 30, 32.

As discussed above, the second lower surface 38 is lower than the first lower surface 36. Each lead 20 also includes a C-shaped intermediate lead portion 62 that extends upward from the first end portion 50 into the first lower surface 36, extends laterally within its respective lateral support 30 or 32, and extends downward toward the second end portion 52 through the first lower surface 36. Thus, the laterally extending portions of the lead are either contained completely within the respective lateral support 30 or 32, or physically abutting the second lower surface 38 of the respective lateral support 30 or 32. Although the laterally extending part of the intermediate lead portion 62 in the disclosed exemplary embodiment is substantially straight and horizontal, it will be appreciated that the laterally extending part of the intermediate lead portion 62 may be curved, arched, or include one or more angled portions that have a laterally extending component. It will be appreciated that the part of the intermediate portion 62 that extends upward from the second end portion 52 may suitably extend adjacent to and abutting the wall 53 that extends vertically between the first lower surface 36 and the second lower surface 38. This provides extra support to the lead 20.

A typical transformer will have two or more coils 22. Each coil 22 will typically include at least a first end 54 and a second end 54, 56. The first end 54 is electrically coupled to and physically affixed to the first end portion 50 of a lead 20. To this end, the first end 54 is typically wrapped around the first end portion 50 and soldered thereto. The second end 56 of the same coil is electrically coupled to and physical affixed to the first end portion 50 of a different lead 20 in the same manner.

As shown most clearly in FIG. 2, each second lower surface 38 is made up of a plurality of second lower surface portions separated by a plurality of first voids 58. Thus, adjacent leads 20 extend along spaced apart, adjacent second lower surface portions 38. In this embodiment, the second lower surface portions 38 and voids 58 are arranged such that the positions of the second lower portions 38 correspond to the spacing of pins in a standard surface mount package. Furthermore, the bottoms of the voids 58 in this embodiment essentially form a continuation of the first lower surface 36. Thus, the second lower surface portions 38 can be considered to be bottom surfaces of pillars 59 that extend downward from the first lower surface 36.

The third lower surface 46 similarly includes a plurality of third lower surface portions separated by a plurality of second voids 60', which preferably align with the plurality of first voids. Similar to the voids 58, the bottoms of the voids 60' in this embodiment essentially form a further continuation of the first lower surface 36. Thus, the third lower surface portions 46 can be considered to be bottom surfaces of pillars 61 that extend downward from the first lower surface 36.

The exemplary device 10 is intended for use as a surface mount device, which means that the second lead ends 52 are typically electrically connected to traces of a printed circuit board using IR reflow processes or other solder techniques. Because the IR reflow process can cause gasses and/or heat to collect, proper ventilation of the area below the device 10 is desirable. The voids or notches 58 (and to some degree voids 60') can assist ventilation. In addition, the voids 60' provide a path for the ends 54, 56 of the coil 22 to pass by the third lower surface portions 46 to the first lead ends 50 well above the third lower surface 46. As a result, the lead ends 50 will not inadvertently contact the printed circuit board. It will be appreciated that the voids 58, 60' may have other shapes, so long as the voids 58 provide some ventilation, and voids 60' provide a path for coil ends 54, 56.

Another feature of the embodiment of FIGS. 1 to 4 relates the manufacturing process, and specifically, the process of coupling the wire ends 54, 56 to the respective first lead ends 50 after the coil 22 is wrapped on the spindle portion 44 of the central bobbin 28. In particular, to enable manipulation of the wire ends 54, 56 around the posts or lead ends 50, excess wire is provided. After the wire ends 54, 56 are wrapped around the post 50, the excess wire must be cut to avoid spurious contact with other lead ends 50, wire ends, or even with traces of the printed circuit board on which the device 10 is mounted.

To facilitate this process in accordance with at least some embodiments of the present invention, the first lower surface 36 includes a channel 60 disposed laterally between the third lower surface 46 and the second lower surface 38, and laterally between the first lead end 50 and the second lower surface 38. The channel 60 provides a guide and/or receptacle for a linear cutting blade, not shown, to trim the excess wire from the wire ends 54, 56. To this end, the channel 60 is preferably v-shaped, and relatively shallow.

Referring to FIG. 2, it will be appreciated that after the wire ends 54, 56 are wrapped around the first lead ends 50, the remaining excess wire for each wire end 50 is laid perpendicularly across the closest channel 60. A straight edge blade is then thrust into or along the each channel 60 to cut the excess wire. This process allows for multiple wire ends 54, 56, etc. to be trimmed with a single manufacturing step. In the prior art, wire ends 54, 56 would have been individually trimmed. The channel 60 allows multiple wires to be trimmed simultaneously, thereby significantly improving manufacturing efficiency.

Still another feature of the device 10 of FIGS. 1 to 4 is an orientation indicating feature 64 which aids the automated placement of the device 10. The orientation indicating feature 64 is a discontinuity molded into the second flange extension 42, and not the first flange extension 40. (See FIGS. 3 and 4). The one-sided location of the feature 64 allows automated pick-and-place equipment, as well as automated or human inspection processes identify the proper orientation of the pins.

It will be appreciated that the various features of the embodiment of FIGS. 1 to 4 may be incorporate into devices having more or less pins, and more coils, or coils with additional taps.

It will also be appreciated that the above-described embodiments are merely illustrative, and that those of ordinary skill in the art may readily device their own implementations and modifications that incorporate the principles of the present invention and fall within the spirit and scope thereof.

We claim:

1. An electronic device comprising:

a molded frame including a central winding bobbin and first and second lateral supports extending laterally outward therefrom, each of the first and second lateral supports including a top surface and first and second lower surfaces;

at least one magnetic element disposed around the central winding bobbin and supported on the top surfaces of the first and second lateral supports, a plurality of leads formed of a conductive material molded in the first and second lateral supports, each of the leads includes a first end portion extending downward from the first lower surface of the corresponding one of the first and second lateral supports, and a second end portion extending along the second lower surface of the corresponding one of the lateral supports, the second lower surface lower than the first lower surface; and at least a first coil wound about the central winding bobbin, a first end of the first coil affixed to the first end portion of a first lead of the plurality of leads, and a second end of the first coil affixed to the first end portion of a second lead of the plurality of leads.

2. The electronic device of claim 1, wherein each second lower surface includes a plurality of second lower surface portions separated by a plurality of first voids, and wherein adjacent leads of the plurality of leads extend along spaced apart, adjacent second lower surface portions.

3. The electronic device of claim 2, wherein each of the first and second lateral supports further comprises a third lower surface, the third lower surface below the first lower surface and above the second lower surface, the first lower surface disposed between the second lower surface and the third lower surface.

4. The electronic device of claim 3, wherein the third lower surface includes a plurality of third lower surface portions separated by a plurality of second voids.

5. The electronic device of claim 4, wherein the first end of the first coil extends through one of the plurality of second voids between adjacent third lower surface portions.

6. The electronic device of claim 1, wherein each of the first and second lateral supports further comprises a third lower surface, which is below the first lower surface and above the second lower surface, the first lower surface disposed between the second lower surface and the third lower surface.

7. The electronic device of claim 6, wherein the third lower surface includes a plurality of third lower surface portions separated by a plurality of voids.

8. The electronic device of claim 7, wherein the first end of the first coil extends through one of the plurality of voids between adjacent third lower surface portions.

9. The electronic device of claim 6, wherein the central winding bobbin includes a spindle portion around which the first coil is wound, and further comprises an inner wall surface extending from the spindle portion to the third lower surface.

10. The electronic device of claim 9, wherein the central winding bobbin further includes first and second upper flange extensions, wherein the first and second upper flange extensions and the inner wall surface cooperate to axially retain the first coil on the spindle portion.

11. The electronic device of claim 1, wherein the each lead includes an intermediate lead portion that extends upward from the first end portion into the first lower surface, extends laterally within a respective one of the first and second lateral supports, and extends downward toward the second end portion through the first lower portion.

12. The electronic device of claim 11, wherein the intermediate lead portion extends laterally in a substantially straight, horizontal direction.

13. The electronic device of claim 11, wherein the intermediate lead portion is substantially c-shaped.

14. The electronic device of claim 1, wherein the first lower surface includes a channel disposed laterally between the first end portions and the second end portions of the leads.

15. The electronic device of claim 14, wherein the channel includes two sides angled toward each other, and extends along an entire length of the first lower surface.

16. The electronic device of claim 1, wherein the first lateral support includes at least a first downward extension extending downward from the first lower surface and defining at least a portion of the second lower surface, and wherein a first lead of the plurality of leads extends from the first lower surface, along and on a side of the downward extension to the second end portion of the first lead.

17. The electronic device of claim 16, wherein each second lower surface includes a plurality of second lower surface portions separated by a plurality of first voids, and wherein the first later support includes a plurality of downward extensions extending downward from the first lower surface and defining the plurality of second lower surface portions, and wherein adjacent leads extend down along a side of a corresponding downward extension and laterally outward along adjacent second lower surface portions.

18. A package for an electronic device comprising:

a molded frame including a central winding bobbin and first and second lateral supports extending laterally outward therefrom, each of the first and second lateral supports including a top surface and first and second lower surfaces, the central winding bobbin including a spindle portion configured to receive at least one wound coil, and the central winding bobbin further including at least two flange extensions extending from opposing ends of the spindle portion; and a plurality of leads formed of a conductive material molded in the first and second lateral supports, each of the leads includes a first end portion extending downward from the first lower surface of the corresponding one of the first and second lateral supports, and a second end portion extending along and abutting the second lower surface of the corresponding one of the lateral supports, the second lower surface lower than the first lower surface.

19. The electronic device package of claim 18, wherein the each lead includes an intermediate lead portion that extends upward from the first end portion into the first lower surface, extends laterally within a respective one of the first and second lateral supports, and extends downward toward the second end portion through the first lower portion.

20. The electronic device package of claim 18, wherein the first lower surface includes a channel disposed laterally between the first end portions and the second end portions of the leads.

* * * * *